US007193606B2

(12) United States Patent
Barnett et al.

(10) Patent No.: US 7,193,606 B2
(45) Date of Patent: Mar. 20, 2007

(54) WEARABLE ELECTRONIC DEVICE

(75) Inventors: Ricky Barnett, Radlett (GB); Jan Chipchase, Tokyo (JP); Jari Vaario, Beijing (FI)

(73) Assignee: Nokia Corporation, Espoo (FI)

( * ) Notice: Subject to any disclaimer, the term of this patent is extended or adjusted under 35 U.S.C. 154(b) by 341 days.

(21) Appl. No.: 10/208,860

(22) Filed: Aug. 1, 2002

(65) Prior Publication Data

US 2003/0025670 A1 Feb. 6, 2003

(30) Foreign Application Priority Data

Aug. 3, 2001 (EP) ..... 01306689

(51) Int. Cl.
*G09G 5/00* (2006.01)

(52) U.S. Cl. ..... 345/156; 345/166; 345/173; 455/566; 455/575; 40/779

(58) Field of Classification Search ..... 345/156–158, 345/163, 166, 173–178; 40/779; 455/566, 455/575, 347
See application file for complete search history.

(56) References Cited

U.S. PATENT DOCUMENTS 4,070,649 A * 1/1978 Wright et al. ..... 382/188
5,088,070 A * 2/1992 Shiff ..... 368/10
5,790,698 A 8/1998 Nguyen et al
5,900,863 A * 5/1999 Numazaki ..... 345/158
6,158,884 A * 12/2000 Lebby et al. ..... 368/282
6,246,482 B1 * 6/2001 Kinrot et al. ..... 356/499
6,825,830 B1 * 11/2004 Kanesaka et al. ..... 345/156
6,882,285 B2 * 4/2005 Dunsmore et al. ..... 340/815.53
2002/0027547 A1 * 3/2002 Kamijo et al. ..... 345/157

FOREIGN PATENT DOCUMENTS

EP 0 660 258 A2 6/1998
EP 0 660 258 A3 8/1998
WO WO 96/36960 11/1996

OTHER PUBLICATIONS

European Search Report

* cited by examiner

*Primary Examiner*—Henry N. Tran
(74) *Attorney, Agent, or Firm*—Alston & Bird LLP

(57) ABSTRACT

A wearable electronic device which includes a base, a display mounted to the base, a user-controllable cursor, a cursor controller for allowing the user to control the position of the cursor on the display, wherein the cursor controller is responsive to a control stimulus from the user acting in a cursor control area remote from the base.

18 Claims, 7 Drawing Sheets

WEARABLE ELECTRONIC DEVICE

BACKGROUND OF THE INVENTION

The present invention relates to a wearable electronic device especially, but not exclusively, a wristwatch.

The functionality of wristwatches has been extended and now wristwatches are available which, as well as telling the time, can, for example, record heart rate, show position globally, play music, synchronise with an organiser and store passwords.

By their very nature, wristwatches impose significant size and style constraints with respect to the user interface. The availability of small-area, high-resolution LCD displays, batteries with longer life, and faster and smaller microprocessors is likely to encourage the development of more complex applications where more intensive user interaction is required.

SUMMARY OF THE INVENTION

The present invention has an aim of facilitating more intensive user interaction with a wearable device, especially, but not exclusively a wristwatch, without violating size and style constraints.

With this in mind, according to one aspect, the present invention may provide a wearable electronic device which includes a base, a display mounted to the base, a user-controllable cursor, and cursor control means for allowing the user to control the position of the cursor on the display, wherein the cursor control means is responsive to a control stimulus from the user acting in a cursor control area remote from the base.

Thus, by the provision of a cursor control means being responsive to a control stimulus acting in a cursor control area remote from the base, the size of the wearable electronic device and the control area by which it's user interface is controlled are made substantially independent from one another.

Preferably, the cursor control means further allows the user to signal a selection operation.

The control stimulus from the user may be in the form of the user's finger or other another pointing device wielded by the user.

In a first embodiment, the wearable electronic device further includes a touch panel. The touch panel provides a control signal to the cursor control means indicative of the position of a control stimulus in the form of contact from a user's finger. The control signal provides an absolute indication of the position of the control stimulus within the control area. The control area preferably amounts to substantially the whole area of the touch panel.

Preferably, the touch panel is moveable from a closed position in a direction away from the base to an open position in which the user can operate the touch panel.

In a second embodiment, the wearable electronic device further includes transceiver means for transmitting and receiving infrared signals. The transceiver means provides a control signal to the cursor control means indicative of the position of a control stimulus in the control area in the form of the presence of a user's finger. The transceiver means generates the control signal by analysing the characteristics of a signal which it transmits after reflection from the user's finger. The control signal provides an absolute indication of the position of the control stimulus within the control area.

In a third embodiment, the wearable electronic device further includes a finger-operated optical mouse. The wearable electronic device further comprises transceiver means for transmitting and receiving optical signals. The transceiver means provides a control signal to the cursor control means indicative of the orientation of the optical mouse. The transceiver means generates the control signal by analysing the characteristics of a signal which it transmits after reflection from the back of the user's hand in the control area. The control signal provides an indication of the desired position of the cursor relative to the current position.

The cursor control area may include an area on, or closely adjacent to the user's body, directly acting on the user's skin or perhaps indirectly acting on the user's skin, for example, via clothing.

In a preferred embodiment of the invention, the electronic device is worn as a wristwatch.

In the context of the present invention, the term 'cursor' should be understood in its broad sense so as to not only include a characteristic mark or character which serves to indicate the current point of user interaction with the contents of the display, but also other ways of indicating the current point of user interaction with the contents of the display, such as, for example, the highlighting of a small, defined portion of the contents of the display, thereby indicating the current point of user interaction.

According to another aspect, the present invention may provide a method for controlling the cursor of a wearable electronic device having a display by sensing a control stimulus from the user acting in a cursor control area remote from the display in an area on or closely adjacent to the user's body.

BRIEF DESCRIPTION OF THE DRAWINGS

Exemplary embodiments of the invention are hereinafter described with reference to the accompany drawings, in which:

FIG. 1(*a*) shows another embodiment of the invention in a closed position;

DETAILED DESCRIPTION OF THE INVENTION

Figure 1:
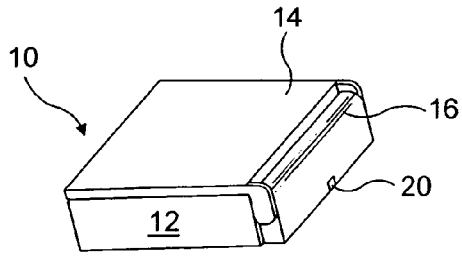
FIG. 1 shows a view of a first embodiment of the invention in a closed position.
Figure 2:
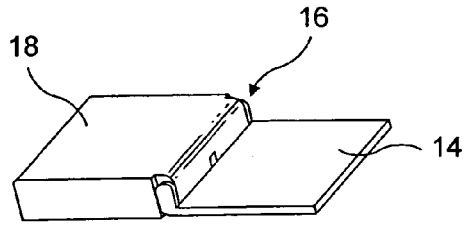
FIG. 2 shows a view of the first embodiment in an open position.

A wearable wristwatch in accordance with a first embodiment of the invention is depicted in FIG. 1 and generally designated 10. The wristwatch comprises a base 12 to which is mounted a transparent touch panel 14 by a hinge 16. The touch panel 14 can be moved from the closed position of FIG. 1 to an open position as in FIG. 2, in which a display 18 mounted to the base 12 is exposed. A microswitch 20 in the base 12 is depressed when touch panel 14 adopts its open, FIG. 2 position.

In other embodiments, such as the embodiment depicted by FIG. 1(*a*), the touch panel 14 may not be transparent, but may include a secondary display 15 which is upward facing when the panel 14 is in the closed position and which duplicates the contents of display 18.

Figure 3:
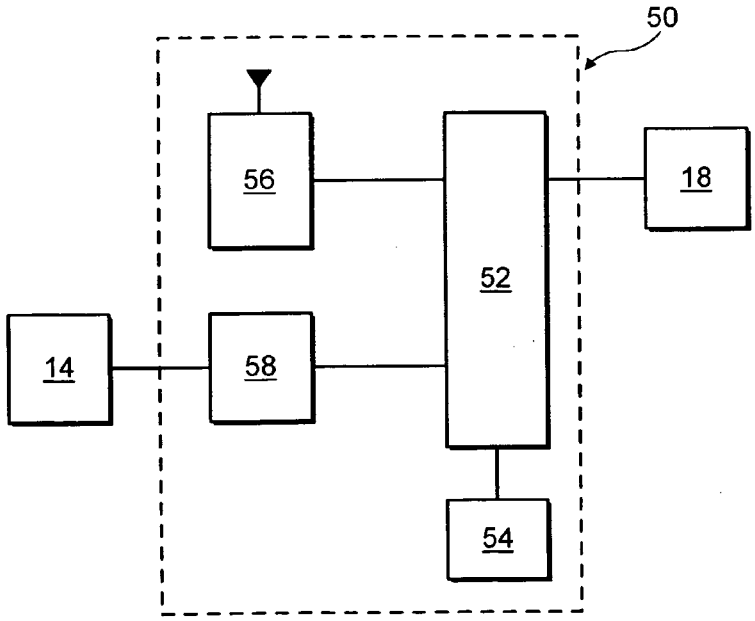
FIG. 3 shows schematically control circuitry of the first embodiment.
Figure 4A:
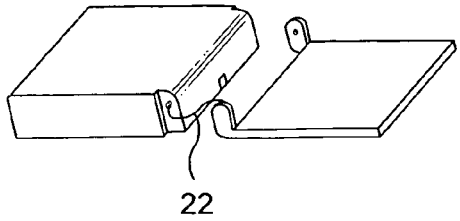
FIGS. 4(*a*) and 4(*b*) show exploded views of FIG. 2.
Figure 4B:
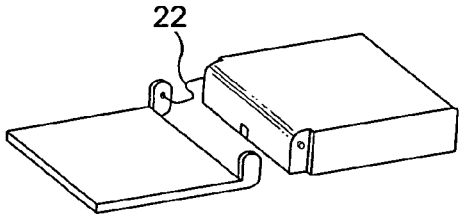

Control circuitry 50, illustrated in FIG. 3, is located inside the base 12 for controlling the operation of the wristwatch 10. The control circuitry 50 comprises a control processor 52 which coordinates the overall operation of the wristwatch 10, drives the display 18, and is connected to a time-keeping module 54 dedicated to keeping accurate time; an RF module 56 providing two-way radio communication, preferably with a cellular system; and a user input module 58 which processes cursor control signals from the user and sends them to the control processor 52. In this embodiment, the user input module 58 is coupled to the touch panel 14. FIGS. 4(*a*) and 4(*b*) show the electrical connection 22 between the touch panel 14 and the control circuitry 50.

Figure 5:
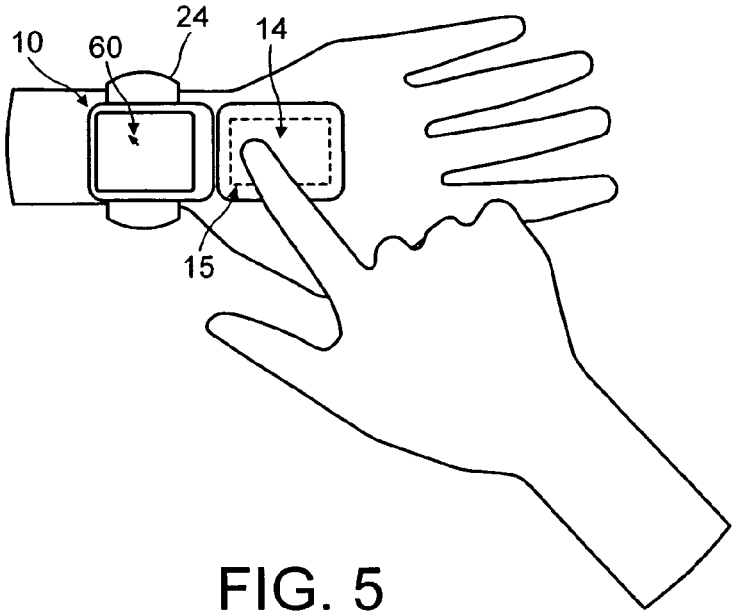
FIG. 5 shows the first embodiment in use mounted to the wrist of a user.

Referring to FIG. 5, in use, the base 12 is fastened to a user's wrist in a conventional manner using a band or strap which is attached to the base on the first peripheral 21 portion and the second peripheral 25 portion of the base. In this embodiment when the touch panel 14 is in the open position as in FIG. 5, the back of the user's hand plays no significant role in supporting the touch panel 14 when it is in it's open position due to the structure of the hinge, although there might be contact or occasional contact between the touch panel 14 and the back of the user's hand. In other embodiments, the structure of the hinge may be such that the back of the user's hand fully supports the touch panel 14 when in it's open position. To move the cursor 60 around the display 18, the user simply moves his finger lightly around the touch panel 14. The pressure from the user's finger causes localized flexing of the outer casing is depressed inwardly and this depression is registered by a small region of the array of sensors therein. The sensors within the touch panel 14 thus generate a set of signals indicative of the position of the depression/user's finger, which signals are received by the user input module 58 and analyzed. The user input module 58 analyses the signals to determine whether they correspond to a small amount of applied pressure, whereby the cluster of sensors detecting the depression is small, or whether the signals correspond to higher applied pressure, whereby the cluster of sensors detecting the depression is relatively large. In the case when the applied pressure is light, the user input module 58 translates those signals into screen position data which sent to the control processor 52. The control processor 52 updates the position of the cursor 60 on the display 18. In the case, when the applied pressure is higher, the user input module 58 interprets this as a 'selection' operation on the part of the user and conveys that information to the control processor.

Figure 6:
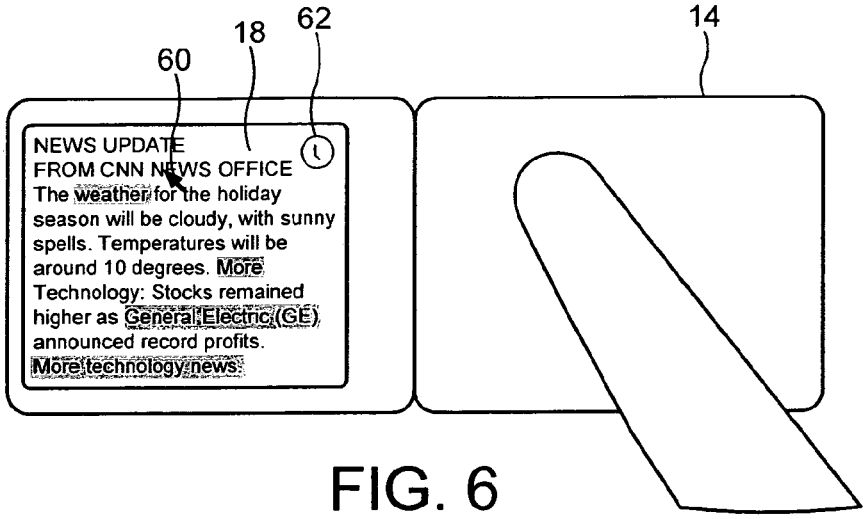
FIG. 6 shows a more detailed view of the first embodiment in use, as in FIG. 5, with parts removed.
Figure 14:
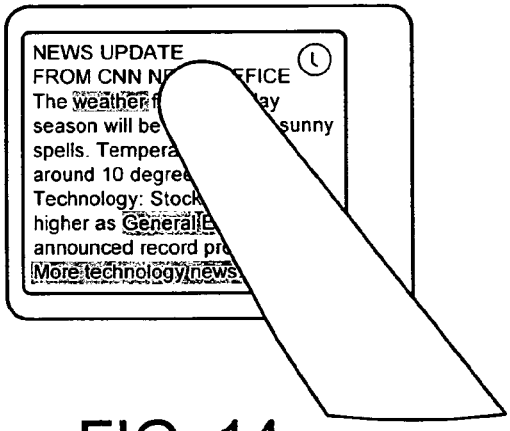
FIG. 14 illustrates an advantage of the first, second and third embodiments of the invention.
Figure 1:
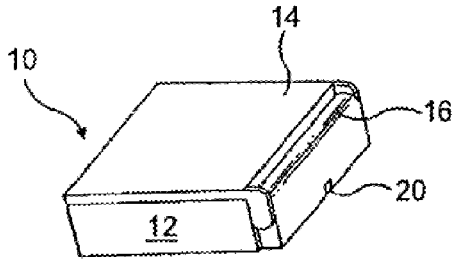
Figure 1A:
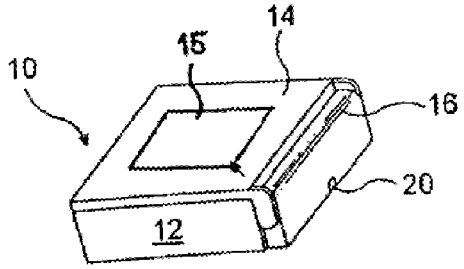
Figure 2:
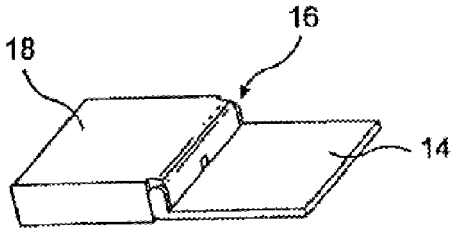
Figure 3:
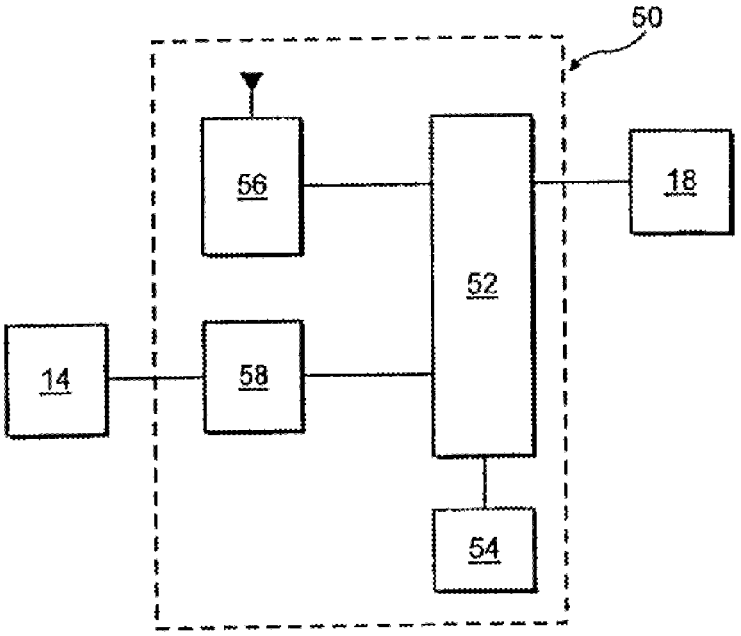
Figure 4A:
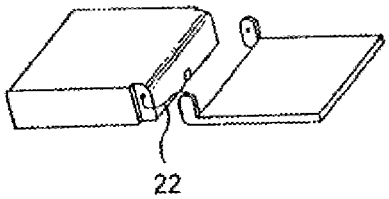
Figure 4B:
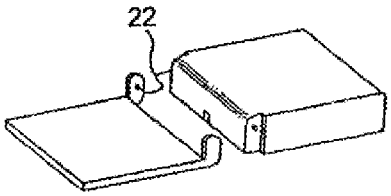
Figure 5:
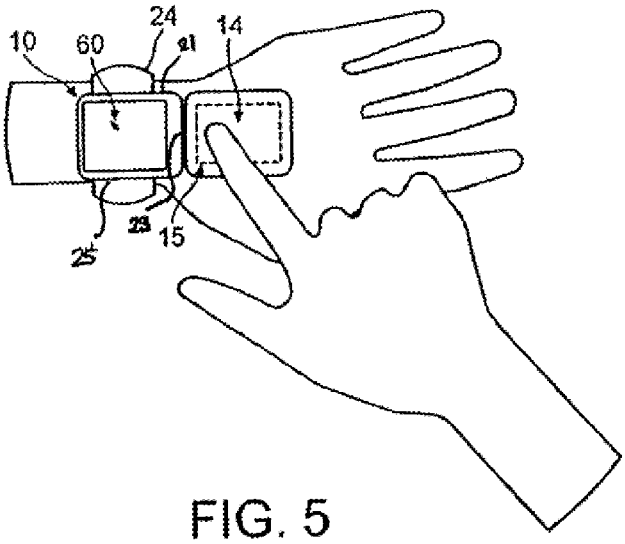
Figure 6:
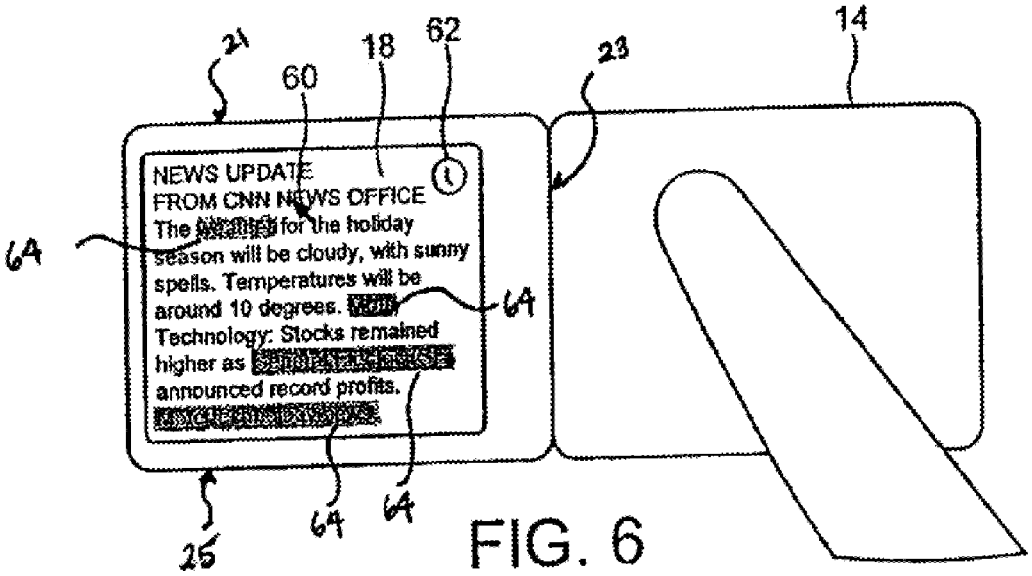
Figure 7:
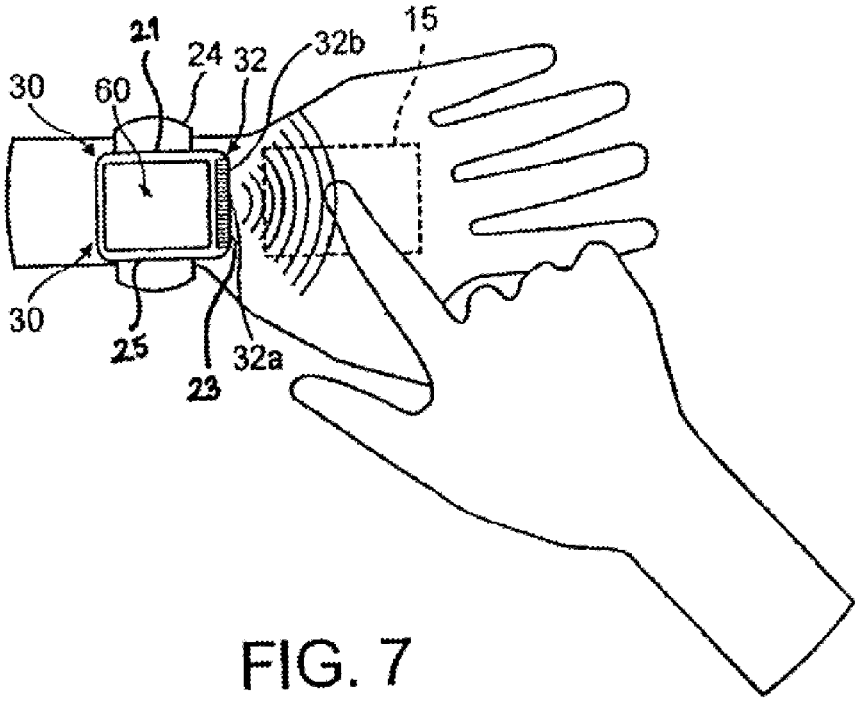
Figure 8A:
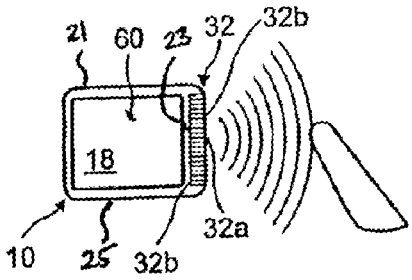
Figure 8B:
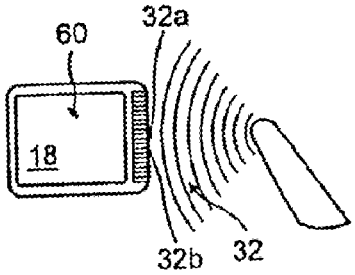
Figure 9:
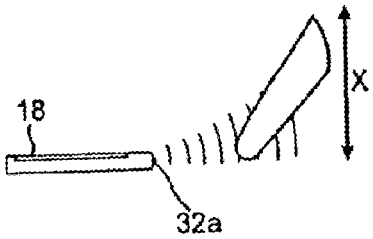
Figure 10:
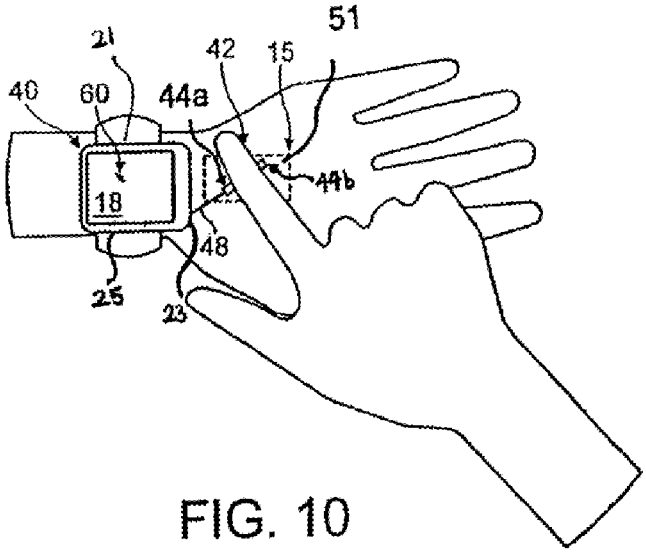
Figure 11A:
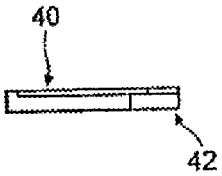
Figure 11B:
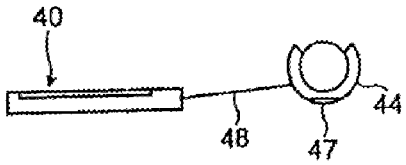
Figure 12A:
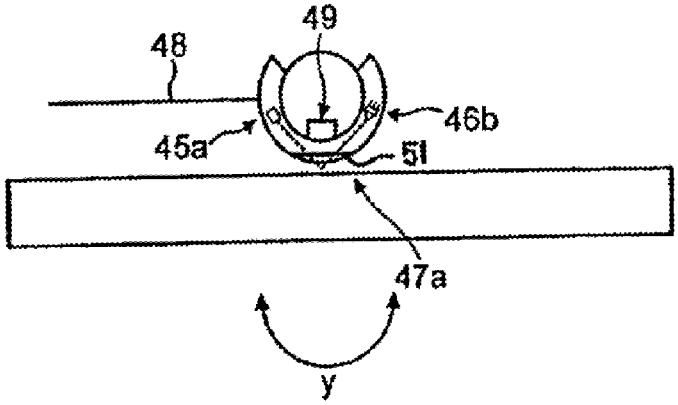
Figure 12B:
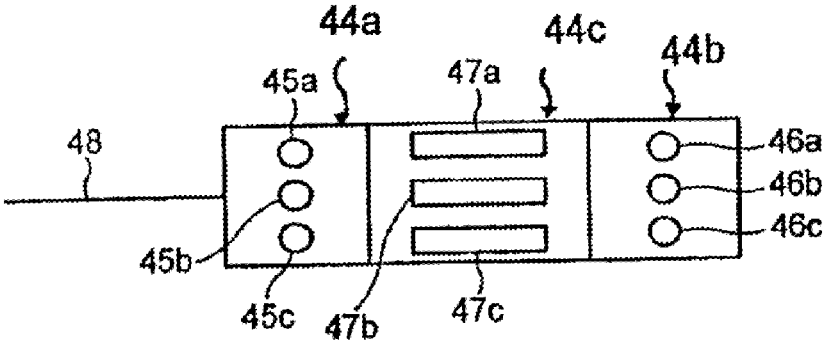
Figure 13:
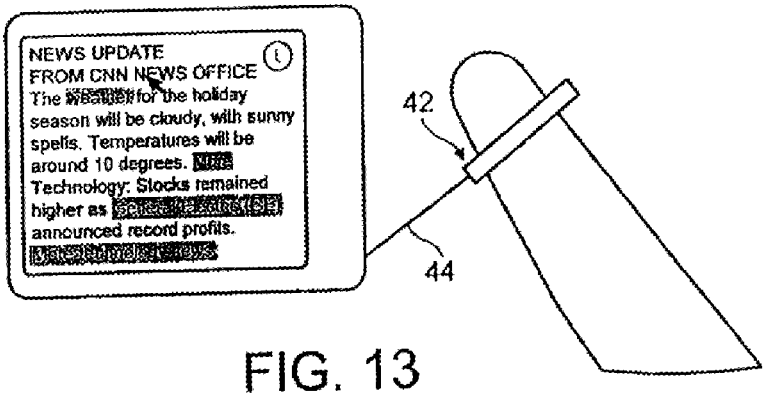
Figure 14:
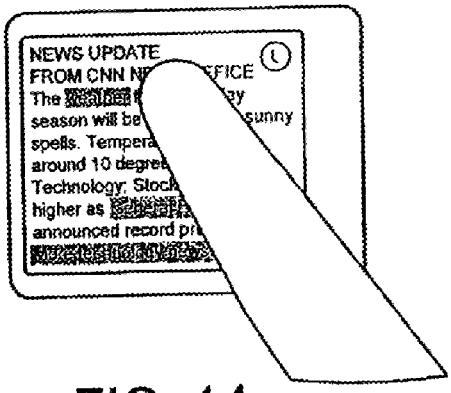

In FIG. 6, the wristwatch 10 has loaded down over the air a page containing an update on the current news from a WAP/I-mode site or other internet source. In the top right hand corner of the display 18, a clock graphic 62, driven by the time-keeping module 54 is shown. The new update contains various highlighted portions 64, which designate the presence of links to other pages of information. The user can manoeuvre the cursor 60 around the display 18 by moving his finger around the touch panel 18, while applying light pressure. FIG. 14 illustrates the advantage of the first embodiment of the invention over a conventional touch screen approach. Because the size of the user's finger is relatively large in relation to the overall size of the display 18, manoeuvring of the cursor tends to obscure most of the display, thereby adversely affecting the manoeuvrability of the cursor 60 and generally inconveniencing the user. In contrast, the first embodiment of the present invention by providing a cursor control area 15, i.e. the touch panel 14, in which the user's finger may roam, the user's view of the display 18 and the cursor 60 is completed unimpeded. When the user wishes to access another page of information, he simply manoeuvres the cursor 60 until it sits on the highlighted portion 64 related to the desired information and applies a firm depression. The firm depression generates a signal in a relatively large amount of sensors within the touch panel 14. In this case, the user input module 58 analyses those signals from the sensors and recognises that the user is making a selection and conveys this information to the control processor 52. The control processor 52 thus then downloads over the air the page of information related to the selected link and then the user can continue to access content.

In another embodiment, the operation of the user simply manoeuvring the cursor and making a selection operation can be distinguished not by the amount of applied pressure as described above, but by a clicking operation where the applied pressure is momentarily released and then re-applied at approximately the same location.

Figure 7:
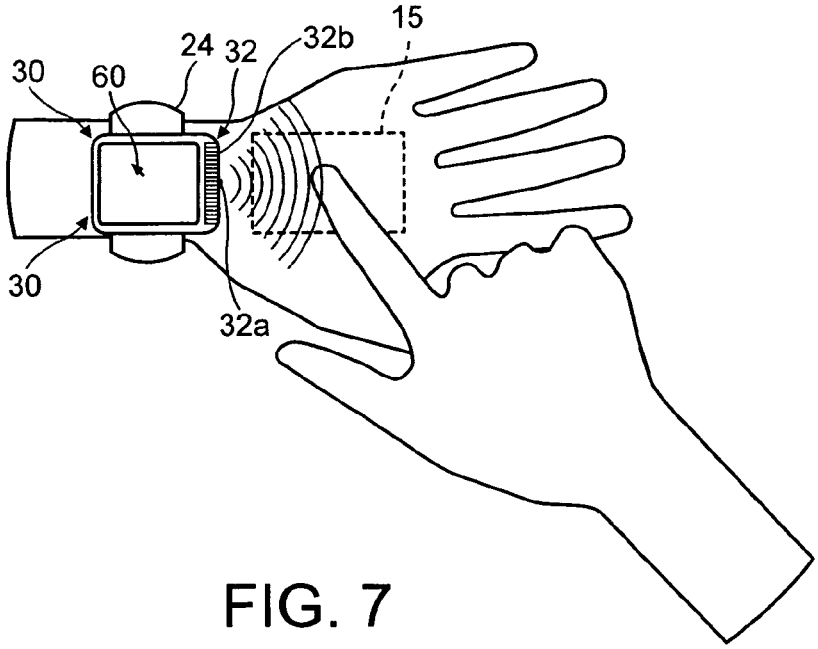
FIG. 7 shows a second embodiment of the invention in used mounted to the wrist of a user.
Figure 8A:
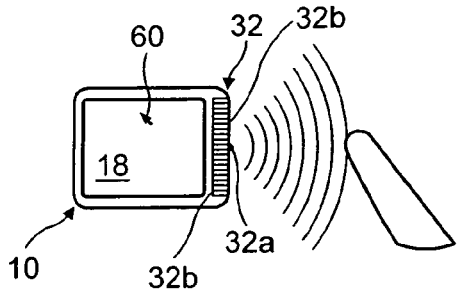
FIGS. 8(*a*) and 8(*b*) illustrate the principle of operation of the second embodiment.
Figure 8B:
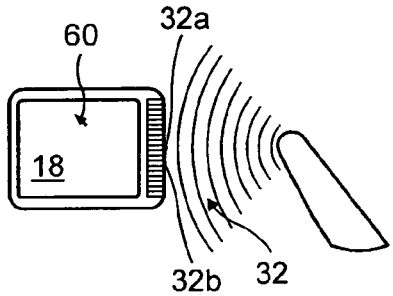

A wearable wristwatch in accordance with a second embodiment of the invention is depicted in FIG. 7 and generally designated 30. Where a part of the second embodiment is similar to a corresponding part in the first embodiment, the same reference numeral is hereinafter used. The second embodiment differs from the first embodiment in that an infrared transceiver unit 32 is used as an input transducer for the user and thus should be understood as taking the place of the touch panel 14 in FIG. 3. The transceiver unit 32 comprises an infrared transmission source 32*a* and an array of infrared detectors 32*b*.

Figure 9:
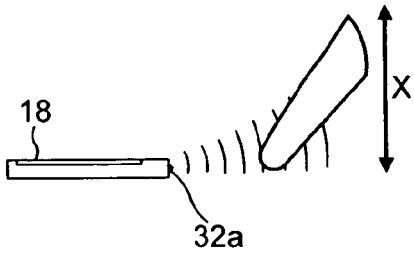
FIG. 9 shows a side view of FIG. 8(*a*)

Referring to FIG. 7, in use, the base 12 is fastened to a user's wrist in a conventional manner using a band or strap 24. To move the cursor 60 around the display 18, the user slides his finger around the back of his other hand, bearing the wristwatch 30, as shown. The device detects and interprets the user's movements using a system located on the third peripheral 23 edge of the base consisting of a transmission source 32*a* and an array of detectors 32*b*. The transmission source 32*a* continuously transmits (see FIG. 8(*a*)) an infrared signal which is reflected by the user's finger. The reflected signal (see FIG. 8(*b*)) is detected by the array of detectors 32*b*. The user input module 58 analyses the signals from the detectors and translates those signals into screen position data which is sent to the control processor 52. The control processor 52 updates the position of the cursor 60 on the display 18. It will be noted that the infrared energy coming from the transmission source 32*a* is highly directional and confined largely to a narrow beam parallel to the surface of the user's hand. In order to perform a 'selection' operation, the user momentarily lifts his finger vertically out of the plane of the which the infrared signal occupies and then replaces it at approximately the same location as indicated by the arrow X in FIG. 9. The fluctuation in the reflected signal which this action produces is recognized by the user input module 58 as selection.

Referring to FIG. 7, as with the first embodiment, the user can download to the wristwatch 30 over the air a page containing an update on the current news from a WAP/I-mode site or other internet source. The user can manoeuvre the cursor 60 around the display 18 by moving his finger around the control area 15. FIG. 14 illustrates the advantage of the second embodiment of the invention over a conventional touch screen approach.

Because the size of the user's finger is relatively large in relation to the overall size of the display 18, manoeuvring of the cursor tends to obscure most of the display, thereby adversely affecting the manoeuvrability of the cursor 60 and generally inconveniencing the user. In contrast, the second embodiment of the present invention by providing a cursor control area 15 in which the user's finger may roam, the user's view of the display 18 and the cursor 60 is completed unimpeded. When the user wishes to access another page of information, he simply manoeuvres the cursor 60 until it sits over a link (not shown in FIG. 7) related to the desired information and momentarily vertically lifts his finger out of the path of the infrared signal from the transmission source 32*a* and then replaces it at approximately the same location. The fluctuation in the reflected signal which this action produces is recognised by the user input module 58 as selection and conveys this information to the control processor 52. The control processor 52 thus then downloads over the air the page of information related to the selected link and then the user can continue to access content.

In order to place the transceiver unit 32 into a power-saving mode, the user can lay his finger immediately adjacent all the infra detectors 32*b* and this is interpreted by the control processor 52 to put the transceiver unit 32 into a power-saving mode, whereby the time gap between transmissions of the transceiver is greatly increased. By performing a similar operation, the transceiver can be brought into normal operational mode, whereby the time gap between transmissions is greatly reduced. In alternative embodiments, a switch on the base 12 can be used to turn the transceiver unit 32 on and off.

Figure 10:
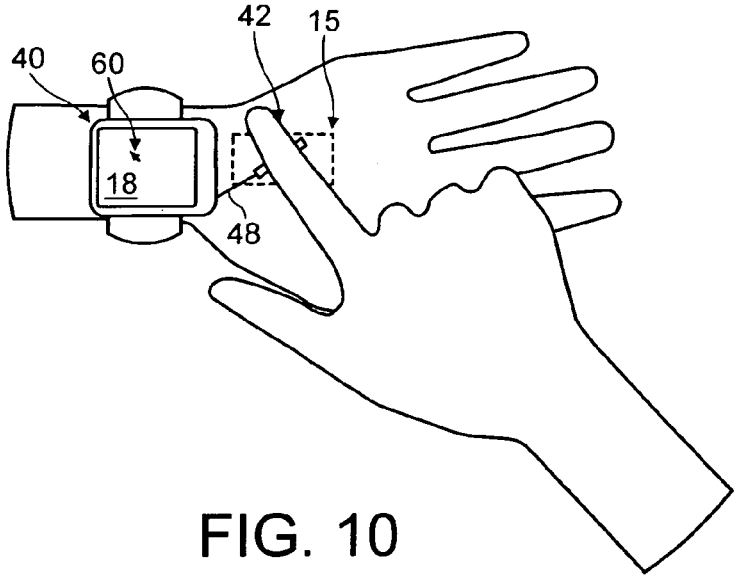
FIG. 10 shows a third embodiment of the invention in use mounted to the wrist of a user.
Figure 11A:
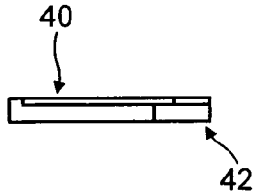
FIGS. 11(*a*) and 11(*b*) show a side view of the third embodiment in a docked and operational condition.
Figure 11B:
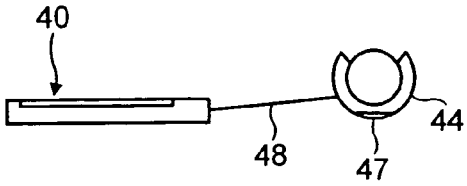
Figure 12A:
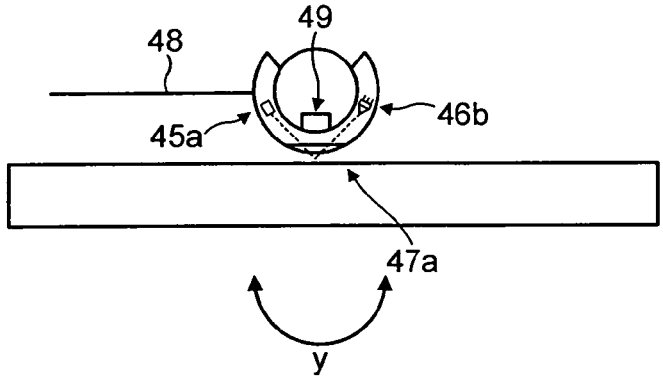
FIGS. 12(*a*) and 12(*b*) illustrate the principle of operation of the optical mouse of the third embodiment.
Figure 12B:
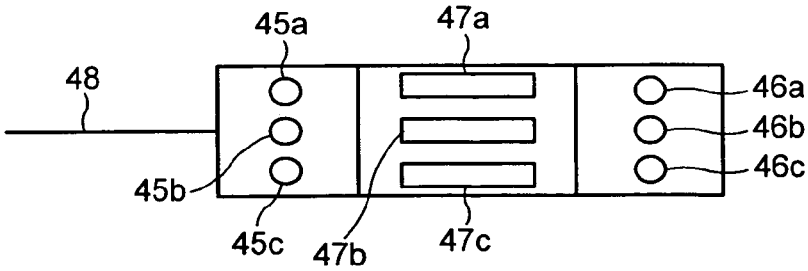

A wearable wristwatch in accordance with a third embodiment of the invention is depicted in FIG. 10 and generally designated 40. Where a part of the first embodiment is similar to a corresponding part in the first or second embodiments, the same reference numeral is hereinafter used. The third embodiment differs from the first and second embodiments in that an optical mouse 42 is used as an input transducer for the user and thus should be understood as taking the place of the touch panel 14 in FIG. 3. The optical mouse 42 comprised a cradle 44 for receiving and retaining a finger of the user. The cradle 44 is in the form of an annulus with a portion cut away, thereby defining two arms, such as portions 44*a* and 44*b* of the cradle, to allow the passage of the user's finger through the cut-away portion whereby the user's finger can rest therein with the major axis of the user's finger perpendicular to the plane of the annulus. The cut-away portion preferably extends less than 180 degrees around the circumference of the annulus to facilitate the retention of the user's transmitter and receiver pairs are located. The transmitters 45*a,b,c* are located in one arm 44*a* of the cradle and the corresponding receivers 46*a,b,c* are located in the other arm 44*b*. In the region, such as portion 44*c* of the cradle, intermediate of the transmitters 45*a,b,c* and receivers 46*a,b,c,* windows 47*a,b,c,* are respectively located. A connecting cable 48 physically and electrically connects the cradle to the rest of the wristwatch 40. A switch 49 is located on the inner wall of the cradle to a position above the windows 47*a,b,c*.

Referring to FIG. 10, in use, the base 12 is fastened to a user's wrist in a conventional manner using a band or strap 24. The optical mouse 42 can be pulled by the user from a storage position as shown in FIG. 11(*a*) to an operational positional as shown in FIG. 11(*b*). A cable supply mechanism is located inside the wristwatch 40 and is not shown in the drawings. The cable supply mechanism supplies a bias to the cable 48 which the user has to overcome in order to pull the cable to the FIG. 11(*b*) position. In the absence of the user's finger, the bias applied by the cable supply mechanism pulls the optical mouse 42 back to it's FIG. 11(*a*) position.

Referring to FIG. 12(*a*), the transmitters 45*a,b,c* continuously transmits a signal at the respective window 47*a,b,c* which is reflected by a reflecting surface 51, such as the back of the user's hand, and received by the respective receivers 46*a,b,c*. If the cradle 44 is rolled about an axis perpendicular to a major plane of the cradle 44 i.e. as indicated by the arrow Y, whereby the portion of its outer surface which directly contacts the back of the user's hand 51 changes and hence the reflected signal received by the respective receiver 46*a,b,c* also changes correspondingly. In this way, the degree to which the cradle has been rolled (i.e. along a line parallel to the arrow Y) can be determined. If the cradle 44 is rocked to and from about an axis perpendicular to the axis of the above mentioned axis, then the relative position of the receiver/transmitter pair 45*a*,46*a* and the receiver/transmitter pair 45*c*,46*c* relative to back of the user's hand 51 varies. In this way, the degree to which the cradle 44 has been rocked can be determined. The user input module 58 analyses the signals from the receivers 46*a,b,c* and translates those signals into degrees of rock and roll data. When the cradle 44 is in the neutral position, the cursor position remains the same. Referring to FIG. 10, in common with the first and second embodiments a cursor control area is shown, but it will be appreciated that the boundaries of this cursor control are more a mental construct for the benefit of the user than physical boundaries, since from the foregoing description, it will be apparent that the cursor position is controlled by the orientation of the cradle 44 relative to a reflecting surface 51 like the back of the user's hand as shown in FIG. 10, rather than an absolute position within the cursor control area. In order to make a selection, the user must firmly depress his finger to actuate the switch 49, which actuation is communicated to the user input module 58. Although for diagrammatic clarity, the switch 49 would hardly stand proud of the inner surface 44 at all or perhaps be slightly recessed so as to ensure that only a conscious and deliberate application of pressure by the user caused its actuation.

Figure 13:
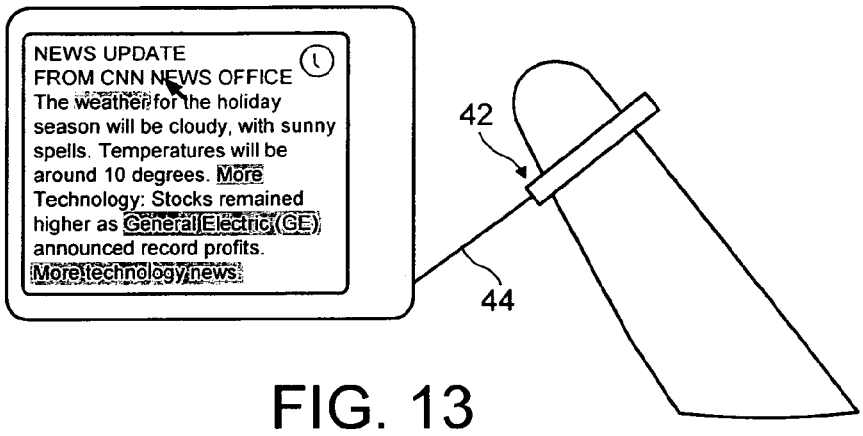
FIG. 13 shows a more detailed view of the third embodiment in use, as in FIG. 10, with parts removed.

Referring to FIG. 13, as with the first and second embodiments, the user can download to the wristwatch 40 over the air a page containing an update on the current news from a WAP/I-mode site or other internet source. With the mouse 42 in its withdrawn position and occupying the cursor control area 15, the user can manoeuvre the cursor 60 around the display 18 by rocking and rolling his finger as described above for the appropriate duration of time. FIG. 14 illustrates the advantage of the third embodiment of the invention over a conventional touch screen approach. Because the size of the user's finger is relatively large in relation to the overall size of the display 18, manoeuvring of the cursor tends to obscure most of the display, thereby adversely affecting the manoeuvrability of the cursor 60 and generally inconveniencing the user. In contrast, the third embodiment of the present invention by providing a cursor control area 15 remote from the display 18, the user's view of the display 18 and the cursor 60 is completed unimpeded. When the user wishes to access another page of information, he simply manoeuvres the cursor 60 until it sits over a link related to the desired information and then actuates the switch 49 which actuation is communicated, via the user input module 58, to the control processor 52. The control processor 52 thus then downloads over the air the page of information related to the selected link and then the user can continue to access content.

In other embodiments, the functionality of the user input module 58 can be implemented in software within the control processor 52.

What is claimed is:

1. A wearable electronic device, comprising:

a base including a first peripheral portion for receiving a fastener, a second peripheral portion for receiving the fastener, and a third peripheral portion between the first and second peripheral portions;

a display mounted to the base;

a user-controllable cursor; and cursor control means for allowing the user to control the position of the cursor on the display, wherein the cursor control means is responsive to a control stimulus from the user acting in a cursor control area remote from the base and adjacent the third peripheral portion of the base.

2. A wearable electronic device as in claim 1, wherein the cursor control means further allows the user to signal a selection operation.

3. A wearable electronic device as in claim 1, wherein the cursor control means is responsive to the position of the control stimulus.

4. A wearable electronic device as in claim 3, comprising a touch panel to which the control stimulus of the user can be applied.

5. A wearable electronic device as in claim 3, further comprising:

a transceiver which includes a transmitter for transmitting a signal into the cursor control area and a receiver for receiving a signal reflected from a control stimulus from the user in the cursor control area.

6. A wearable electronic device as in claim 3, wherein the cursor control means responds to the control stimulus as an indicator of a required change in the position of the cursor.

7. A wearable electronic device as claimed in claim 4, wherein the touch panel is pivotally coupled to the base to allow the touch panel to move between an open position and a closed position.

8. A wearable electronic device as claimed in claim 7, wherein the touch panel comprises a further display which is located to allow the user to view the further display when the touch panel is in the closed position.

9. A wearable electronic device as in claim 1, wherein the device is worn as a wristwatch.

10. A wearable electronic device as in claim 1, further comprising an optical mouse.

11. A wearable electronic device as in claim 10, wherein the optical mouse includes a switch by which the selection operation is chosen.

12. A wearable electronic device as claimed in claim 10, wherein the optical mouse comprises a cradle for receiving a finger of the user.

13. A wearable electronic device as claimed in claim 12, wherein the optical mouse comprises at least one optical transmitter in a first portion of the cradle, at least one optical window in a second portion of the cradle and at least one optical receiver in a third portion of the cradle wherein, in use, light transmitted by the optical transmitter is reflected by a reflecting surface beyond the optical window to be received by the optical receiver, wherein the light received depends upon the orientation of the optical window relative to the reflecting surface.

14. A wearable electronic device as claimed in claim 13, wherein the orientation of the optical window relative to the reflecting surface is varied by rocking the cradle on the reflecting surface.

15. A method for controlling the cursor of a wearable electronic device having a display by sensing a control stimulus from a user acting in a cursor control area remote from the display in an area on or closely adjacent to a user's body, the wearable electronic device comprising:

a base including a first peripheral portion for receiving a fastener, a second peripheral portion for receiving the fastener, and a third peripheral portion between the first and second peripheral portions;

the display mounted to the base;

a user controllable cursor; and cursor control means for allowing the user to control the position of the cursor on the display, wherein the cursor control means is responsive to the control stimulus from the user acting in the cursor control area remote from the base and adjacent the third peripheral portion of the base.

16. A wearable electronic device as in claim 2, wherein the cursor control means is responsive to the position of the control stimulus.

17. A wearable electronic device, comprising:

a base;

a display mounted to the base;

a user controllable cursor;

a fastener for fastening the base to a user; and cursor control means for allowing the user to control a position of the cursor on the display, wherein the cursor control means is moveable with respect to the base and to the display, is remote from the fastener and is responsive to a control stimulus from the user acting in a cursor control area remote from the base.

18. A wearable electronic device, comprising: a base;

a display mounted to the base;

a user-controllable cursor;

cursor control means for allowing the user to control the position of the cursor on the display, wherein the cursor control means is responsive to a control stimulus from the user acting in a cursor control area remote from the base; and a transceiver which includes a transmitter for transmitting a signal into the cursor control area and a receiver for receiving a signal reflected from a control stimulus from the user in the cursor control area, wherein a selection operation is achieved by momentarily removing the control stimulus from the field of view of the transmitter, and wherein the cursor control means is responsive to a position of the control stimulus.

* * * * *

UNITED STATES PATENT AND TRADEMARK OFFICE

CERTIFICATE OF CORRECTION

PATENT NO. : 7,193,606 B2
APPLICATION NO. : 10/208860
DATED : March 20, 2007
INVENTOR(S) : Barnett et al.

It is certified that error appears in the above-identified patent and that said Letters Patent is hereby corrected as shown below:

The title page showing the illustrative figure should be deleted to be replaced with the attached title page.

The drawing sheets, consisting of Figs. 1-7, should be deleted to be replaced with the drawing sheets, consisting of Figs. 1-7, as shown on the attached page.

Signed and Sealed this

Seventeenth Day of June, 2008

JON W. DUDAS
*Director of the United States Patent and Trademark Office*

(12) United States Patent
Barnett et al.

(10) Patent No.: US 7,193,606 B2
(45) Date of Patent: Mar. 20, 2007

(54) WEARABLE ELECTRONIC DEVICE

(75) Inventors: Ricky Barnett, Radlett (GB); Jan Chipchase, Tokyo (JP); Jari Vaario, Beijing (FI)

(73) Assignee: Nokia Corporation, Espoo (FI)

( * ) Notice: Subject to any disclaimer, the term of this patent is extended or adjusted under 35 U.S.C. 154(b) by 341 days.

(21) Appl. No.: 10/208,860

(22) Filed: Aug. 1, 2002

(65) Prior Publication Data

US 2003/0025670 A1 Feb. 6, 2003

(30) Foreign Application Priority Data

Aug. 3, 2001 (EP) ..... 01306689

(51) Int. Cl.
*G09G 5/00* (2006.01)

(52) U.S. Cl. ..... 345/156; 345/166; 345/173; 455/566; 455/575; 40/779

(58) Field of Classification Search ..... 345/156–158, 345/163, 166, 173–178; 40/779; 455/566, 455/575, 347

See application file for complete search history.

(56) References Cited

U.S. PATENT DOCUMENTS 4,070,649 A * 1/1978 Wright et al. ..... 382/188
5,088,070 A * 2/1992 Shiff ..... 368/10
5,790,698 A 8/1998 Nguyen et al
5,900,863 A * 5/1999 Numazaki ..... 345/158
6,158,884 A * 12/2000 Lebby et al ..... 368/282
6,246,482 B1 * 6/2001 Kiarol et al. ..... 356/499
6,825,830 B1 * 11/2004 Kanesaka et al. ..... 345/156
6,882,285 B2 * 4/2005 Dunsmore et al ..... 340/815.53
2002/0027547 A1 * 3/2002 Kamijo et al. ..... 345/157

FOREIGN PATENT DOCUMENTS

EP 0 660 258 A2 6/1998
EP 0 660 258 A3 8/1998
WO WO 96/36960 11/1996

OTHER PUBLICATIONS

European Search Report

* cited by examiner

*Primary Examiner*—Henry N. Tran
(74) *Attorney, Agent, or Firm*—Alston & Bird LLP

(57) ABSTRACT

A wearable electronic device which includes a base, a display mounted to the base, a user-controllable cursor, a cursor controller for allowing the user to control the position of the cursor on the display, wherein the cursor controller is responsive to a control stimulus from the user acting in a cursor control area remote from the base.

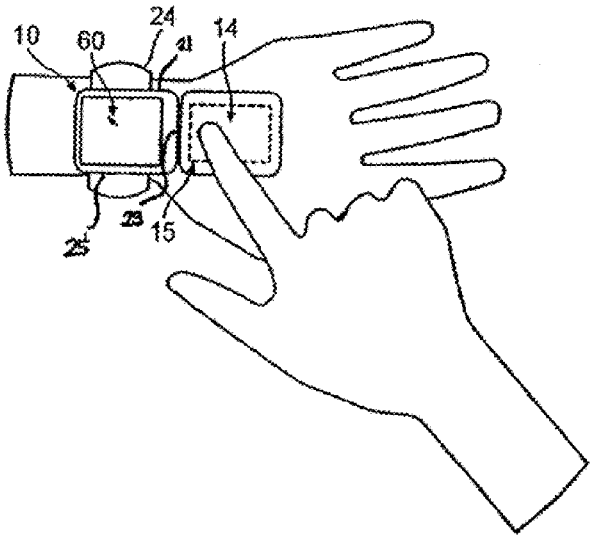

18 Claims, 7 Drawing Sheets